United States Patent [19]

Wallach

[11] 4,145,762

[45] Mar. 27, 1979

[54] SWIM TRUNKS WITH REVERSIBLE POCKET

[75] Inventor: Marc Wallach, Huntingdon Valley, Pa.

[73] Assignee: Donmoor, Inc., New York, N.Y.

[21] Appl. No.: 868,742

[22] Filed: Jan. 12, 1978

[51] Int. Cl.[2] ..... A41D 7/00

[52] U.S. Cl. ..... 2/67; 2/238; 2/247; 2/69

[58] Field of Search ..... 2/238, 67, 69, 69.5, 2/227, 211, 247, 2.1, 404, 403; 128/513, 574; 224/46 R

[56] References Cited

U.S. PATENT DOCUMENTS

| | | | |
|---|---|---|---|
| 2,446,326 | 8/1948 | Guithues | 2/67 X |
| 2,544,840 | 3/1951 | Kowatsch | 2/67 |
| 2,791,775 | 5/1957 | Sartell | 2/69.5 |
| 3,085,254 | 4/1963 | Cutler | 2/247 |
| 3,176,315 | 4/1965 | Freund | 2/69 |

*Primary Examiner*—H. Hampton Hunter

*Attorney, Agent, or Firm*—Michael Ebert

[57] ABSTRACT

Swim trunks formed by a piece of fabric contoured to define a waist and a pair of leg sections, the fabric having a side seam extending between the waist and the lower end of one leg. The seam is interrupted to form a slit whose edges are secured to the complementary tapes of a zipper and to the sides of a pocket. In its normal state, the pocket is interposed between the inner surface of one leg of the trunks and a loose liner suspended from the waist and conforming to the contours of the trunk. The zipper includes a slider having a double pull tab. The outside tab serves to open and close the pocket in its normal mode when the pocket is usable to carry keys and other small items. The inside tab serves to open and close the pocket when it is pulled inside out to function in the reverse state as a carry bag into which the trunks are stuffed. One side of the pocket is provided with a pair of eyelets through which a string is looped, the bag being held from the string in the reverse mode of the pocket.

3 Claims, 6 Drawing Figures

Fig. 3.
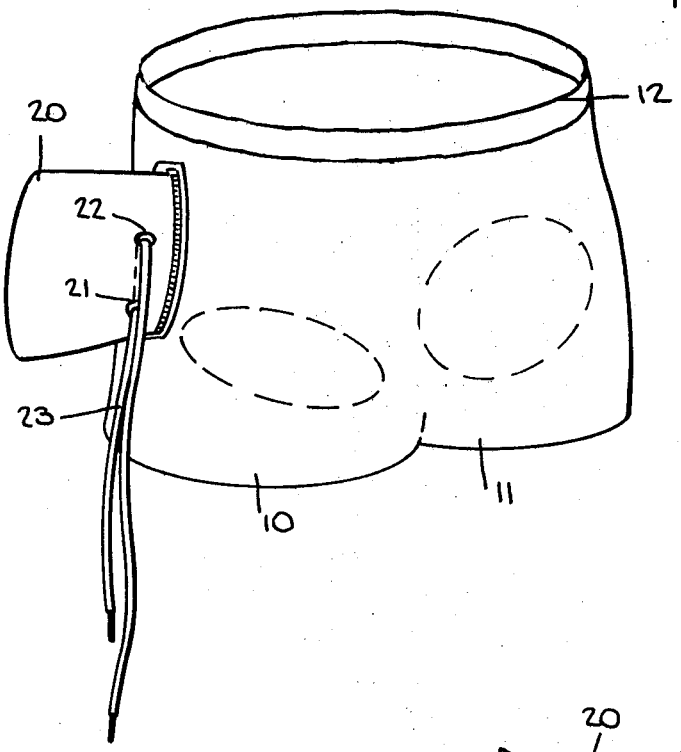
Fig. 6.
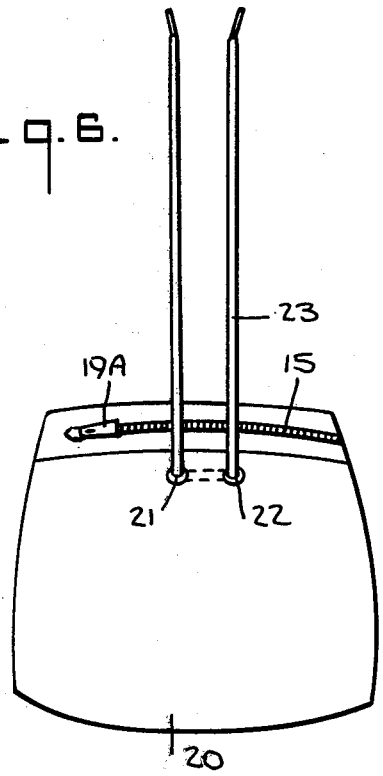
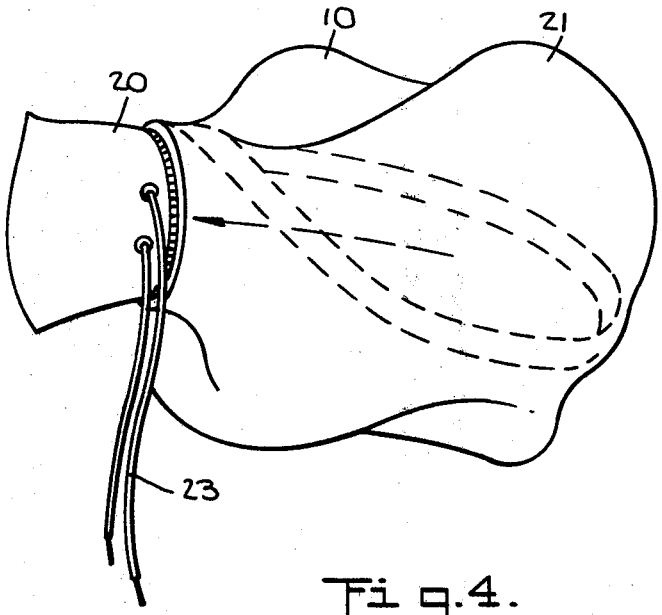
Fig. 4.
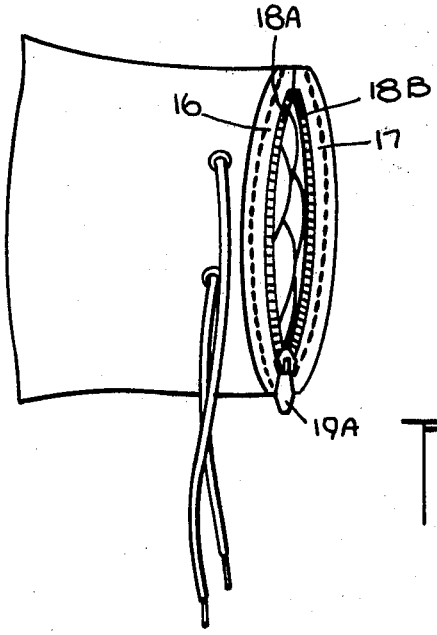
Fig. 5.

SWIM TRUNKS WITH REVERSIBLE POCKET

BACKGROUND OF INVENTION

This invention relates generally to swimsuits or bathing trunks, and more particularly to trunks which include a reversible pocket which in its normal mode serves as a receptacle for articles to be taken into the water by the wearer and in its reverse mode functions as a pouch to receive the trunks.

The Kowatsch U.S. Pat. No. 2,544,840 and the Harris U.S. Pat. No. 1,714,365 both disclose bathing trunks provided with a reversible pocket which normally serves to carry articles such as keys and other small items into the water. The pocket is so arranged on the trunks that it may be reversed to define a carry bag having the trunks stuffed therein.

One drawback in such known reversible pocket arrangements is that the pocket in its normal mode lies between the inner surface of the trunks and the thigh of the wearer, so that if the pocket is filled with irregular items, these items rub against the wearer and create some degree of discomfort.

Moreover, when the pocket is reversed and the trunks stuffed therein, the resultant pouch cannot be tied, say, to the handles of a bicycle or carried as a bag from a string or handle, for no means are provided for this purpose.

Another disadvantage of known forms of reversible pockets for swim trunks is that the pocket placement is such that its slide fastener opening extends across the front of the trunks. This arrangement calls attention to the presence of a pocket, which is undesirable not only in terms of appearance but also from the practical standpoint, for the fact that the wearer may be carrying some items of value should not be made evident.

SUMMARY OF INVENTION

In view of the foregoing, the main object of this invention is to provide improved swim trunks having a reversible pocket which in the normal mode is adapted to carry keys and other small objects into the water, and in the reverse mode functions as a carry bag for the trunks stuffed therein.

More particularly, it is an object of the invention to provide swim trunks having a reversible pocket which is interposed between the trunks and a loose liner suspended from the waist of the trunk. A significant feature of the liner is that it shields the wearer from direct contact with the pocket and the contents thereof, yet it does not prevent stuffing of the trunks into the pocket when the pocket is pulled inside out.

Also an object of the invention is to provide swim trunks of the above-type whose pocket is combined with a string which in the normal mode lies within the pocket and in the reverse mode serves to suspend the carry bag to facilitate handling thereof.

Yet another object of this invention is to provide a pocket for swim trunks which is integrated with a side seam thereof whereby the existence of the pocket is masked to prevent an apparent discontinuity in the appearance of the trunks and also to avoid calling attention to the pocket.

Briefly stated, these objects are attained by swim trunks formed by a piece of fabric contoured to define a waist and a pair of leg sections, the fabric having a side seam extending between the waist and the lower end of one leg. The seam is interrupted to form a slit whose edges are secured to the complementary tapes of a zipper and to the sides of a pocket which in the normal mode is interposed between the inner surface of one leg of the trunks and a loose liner suspended from the waist and conforming to the contours of the trunk.

The zipper includes a slider having a double pull tab. The outside tab serves to open and close the pocket in its normal mode when the pocket is usable to carry keys and other small items. The inside tab serves to open and close the pocket when it is pulled inside out to function in the reverse mode as a carry bag into which the trunks are stuffed. One side of the pocket is provided with a pair of eyelets through which a string is looped, the bag being suspended from the string in the reverse mode of the pocket.

OUTLINE OF DRAWINGS

For a better understanding of the invention as well as other objects and further features thereof, reference is made to the following detailed description to be read in conjunction with the accompanying drawings, wherein:

FIG. 3 illustrates the trunks with the pocket thereof pulled inside out;

FIG. 4 shows the trunks in the process of being stuffed in the inside-out pocket;

FIG. 5 shows the trunks when fully stuffed into the pocket, but before the zipper is closed; and FIG. 6 shows the trunks stuffed into the pocket with the zipper closed, the pocket now functioning as a carry bag suspended from a string.

DESCRIPTION OF INVENTION

Figure 1:
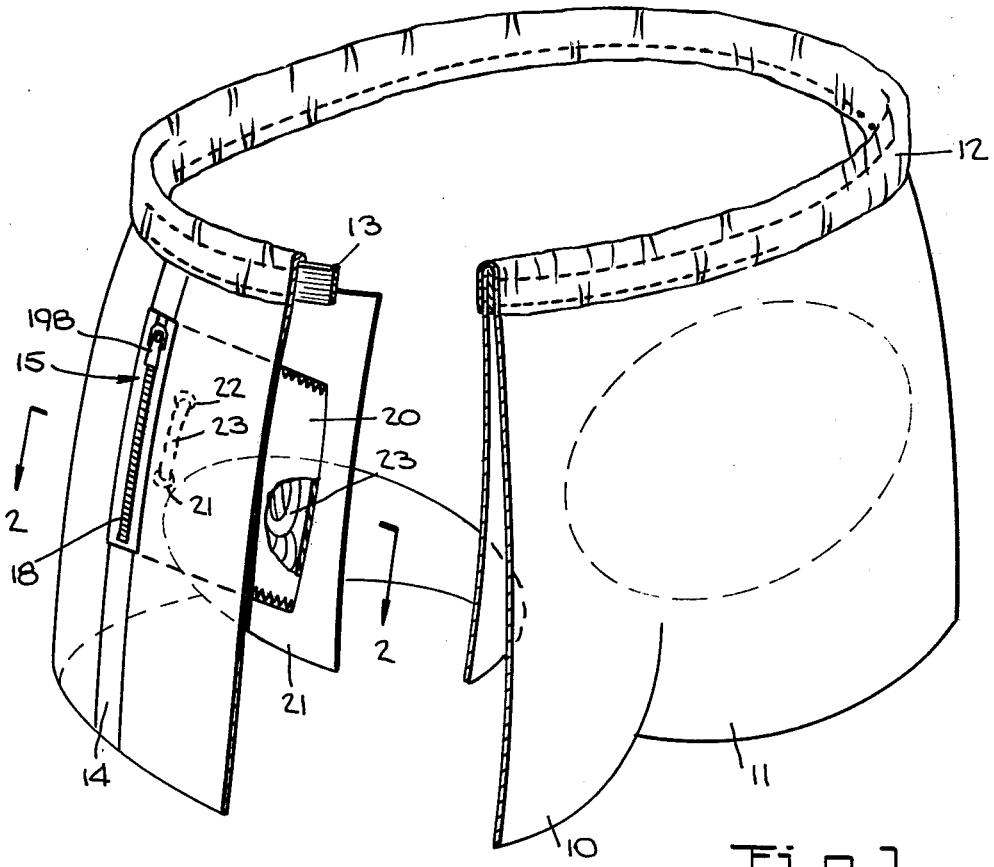
FIG. 1 is a perspective front view of swim trunks in accordance with the invention, the front of the trunks being cut away to expose the reversible pocket.
Figure 2:
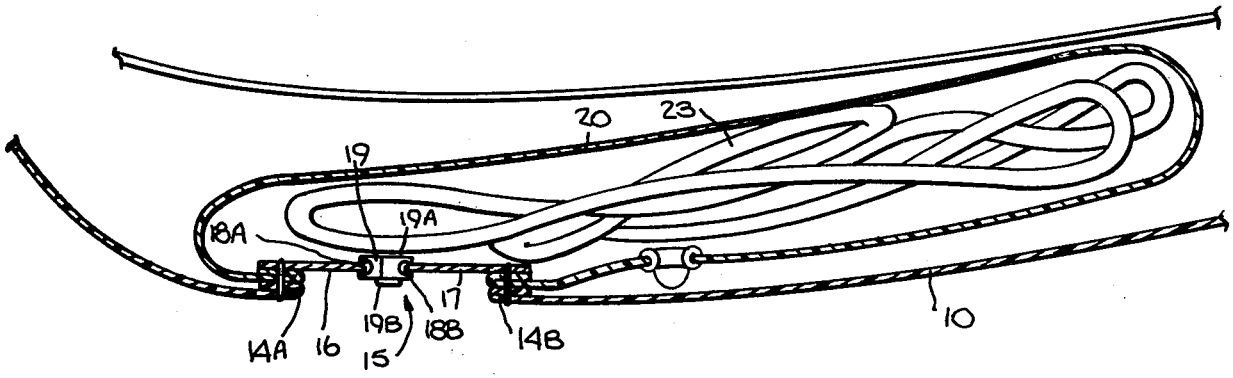
FIG. 2 is a section taken in the plane indicated by lines 2—2 in FIG. 1.

Referring now to FIGS. 1 and 2, there is shown a preferred embodiment of swim trunks in accordance with the invention. The trunks are formed by a fabric which tends to shed water, such as a plastic-coated woven nylon material, the fabric piece being contoured to define a pair of leg sections 10 and 11 and a stretchable waist 12.

Waist 12 encircles the waist of the wearer, whereas leg sections 10 and 11 surround the wearer's thighs. Waist 12 is stitched to create a puckered toroid within which is inserted a band 13 of elastic material, such that when the waist 12 is stretched to accommodate the waist of the wearer, the band is expanded.

The trunks are provided with a seam 14 which runs along the side of leg section 10 between the waist 12 and the bottom of the leg section. This seam is not visible when one looks toward the rear or front of the trunks—the seam, therefore, being relatively inconspicuous.

Seam 14 is interrupted to form a slit accommodating a slide fastener or zipper, generally designated by numeral 15. As best seen in FIG. 2, zipper 15 is provided with a pair of tapes 16 and 17 that carry complementary fastener elements 18A and 18B which are joined together or detailed by a slider 19. The zipper is preferably of the type employing interlocking helical nylon fastening elements which are immune to salt water.

As best seen in FIG. 2, the complementary edges 14A and 14B of the slit formed in seam 14 are stitched or otherwise secured to tapes 16 and 17 of the zipper as well as to the opposing sides of a pocket 20 which is made of the same material as the trunks. Pocket 20 in its normal mode is interposed between the inner surface of leg section 10 of the trunks and a loose fabric liner 21 preferably formed of woven nylon fabric. The liner is suspended within the trunks from waist 12, the configuration of the liner matching that of the trunks to define two inner leg sections.

One side of pocket 20 is provided with a pair of spaced eyelets 21 and 22 through which is looped a string 23, the string normally lying within the pocket. In the normal mode, as shown in FIG. 1, pocket 20 is interposed between the inner surface of leg section 10 and liner 21, so that the liner shields the wearer's thigh from the pocket and from the items carried therein.

Slider 19 of zipper 15 is provided with a double pull tab, constituted by an inner pull tab 19A and an outer pull tab 19B. When pocket 20 lies within the trunks in its normal mode as shown in FIG. 2, outer pull tab 19B functions to open and close the zipper to provide access to the pocket. When pocket 20 is reversed to function in the reverse mode as a pouch or carry bag as shown in FIG. 5, the inner pull tab 19A that normally lies within the pocket is now on the outside thereof and serves to open and close the zipper to provide access to the pouch.

The conversion of the pocket from its normal to its reverse mode is shown in FIG. 3 where pocket 20 is pulled inside out, in which mode string 23 dangles from the pocket. Then, as shown in FIG. 4, the trunks and liner 21 therefor are stuffed within the pocket, the pocket now serving as a pouch, as shown in FIG. 5. Because the liner is loose, it does not interfere with the stuffing operation.

The zipper is closed by means of pull tab 19A and the resultant stuffed pouch is suspended from string 23 which makes it possible to carry the pouch as a carry bag or to tie it to a bicycle or other vehicle.

While there has been shown and described a preferred embodiment of swim trunks with reversible pocket in accordance with the invention, it will be appreciated that many changes and modifications may be made therein without, however, departing from the essential spirit thereof. For example, the pocket may be made of plastic-coated woven material impermeable to water, whereas the trunks may be made of a porous fabric so that when wet trunks are stuffed within the pocket, the pocket serves as a waterproof container therefor.

I claim:

1. Swim trunks comprising:

A. a fabric piece formed of synthetic fabric material which is plastic-coated to render it impermeable to water and contoured to define a waist and a pair of leg sections;

B. a loose liner of woven nylon fabric suspended from the waist and conforming to the contours of the trunks;

C. a pocket normally interposed between one of said leg sections and said liner, said pocket being formed of the same material as the fabric piece;

D. a slide fastener having complementary tapes secured both to opposing sides of said pocket and to the edges of a slit formed in said trunks, said slide fastener being formed of interlocking helical nylon fastening elements which are immune to salt water and provided with a slider having a double pull tab, the outer tab serving to open and close the pocket in its normal mode within the trunks when it is usable to carry keys and other items, the inner tab serving to open and close the pocket when it is pulled inside out to function in the reverse mode as a carry bag into which the trunks are stuffed;

E. a pair of eyelets attached at spaced positions to one side of the pocket; and F. a string looped through the eyelets, said string lying within the pocket in its normal mode and being concealed thereby and serving to suspend the bag in the reverse mode when the string is exposed.

2. Swim trunks as set forth in claim 1, wherein said trunks are provided with a side seam extending from the waist to the lower end of one of said leg sections, said slit interrupting said seam.

3. Swim trunks as set forth in claim 1, wherein said waist is formed by a puckered toroid having an elastic band inserted therein to define a stretchable waist.

* * * * *